US006736076B2

(12) United States Patent
Kaltenmark et al.

(10) Patent No.: US 6,736,076 B2
(45) Date of Patent: May 18, 2004

(54) APPARATUS AND METHOD FOR PROVIDING A FOLD-UP WOODEN TABLE

(75) Inventors: Eric M. Kaltenmark, Chuckey, TN (US); Anne C. Underwood, Johnson City, TN (US)

(73) Assignee: Meco Corporation, Greenville, TN (US)

( * ) Notice: Subject to any disclaimer, the term of this patent is extended or adjusted under 35 U.S.C. 154(b) by 0 days.

(21) Appl. No.: 10/128,650

(22) Filed: Apr. 18, 2002

(65) Prior Publication Data

US 2003/0196575 A1 Oct. 23, 2003

Related U.S. Application Data

(60) Provisional application No. 60/284,824, filed on Apr. 19, 2001.

(51) Int. Cl.[7] ..... A47B 3/00

(52) U.S. Cl. ..... 108/132; 108/115; 248/118.6

(58) Field of Search ..... 108/115, 132, 108/131, 128, 129; 248/188.6

(56) References Cited

U.S. PATENT DOCUMENTS

| | | | | |
|---|---|---|---|---|
| 236,197 A | | 1/1881 | Valley | |
| 317,097 A | * | 5/1885 | Danner | 108/132 |
| 1,133,109 A | * | 3/1915 | Derbyshire | 108/132 |
| 1,504,371 A | | 8/1924 | Ormenrod | |
| 1,757,260 A | | 5/1930 | Silverman | |
| 3,271,914 A | * | 9/1966 | Boyett | 52/36.3 |
| 3,628,471 A | * | 12/1971 | Burr | 108/132 |
| 3,945,328 A | * | 3/1976 | Hendrickson et al. | 108/132 |
| 4,318,353 A | * | 3/1982 | Schier | 108/132 |
| 5,322,022 A | * | 6/1994 | Burkholder | 108/48 |

FOREIGN PATENT DOCUMENTS

GB 2218625 * 11/1989

* cited by examiner

*Primary Examiner*—Jose V. Chen
(74) *Attorney, Agent, or Firm*—McGuireWoods LLP

(57) ABSTRACT

An apparatus and method for providing a folding wooden table is disclosed wherein the table retains the attractiveness of traditional wooden tables by having hidden hinges and leg supports, yet which folds flat for storage and requires no tools for assembly and disassembly. The underside of the table top has a side skirt pivotally secured adjacent to each side with at least one hinge so as to enable them to fold inward. End skirts are pivotally secured to the table top at each end with at least one hinge, and a pair of legs are secured to opposite ends of each end skirt to form a pivoting leg assembly. The legs preferably have an "L"-shaped cross-section to hide the support hardware yet provide an attractive exterior. The hinge is offset sufficiently inward from end skirt to allow legs to fold flat against the table top. An "L"-shaped support bracket is secured to each end of the side skirts with an appropriately positioned pivot. The end of the support bracket opposite pivot includes a retention slot to engage a boss on an inside of each leg when rotated into a securing position. A sliding and/or pivoting retention member is then used to lock the support bracket into position to complete the erection of the fold-up table.

3 Claims, 2 Drawing Sheets

APPARATUS AND METHOD FOR PROVIDING A FOLD-UP WOODEN TABLE

RELATIONSHIP TO APPLICATIONS

This application claims the benefit of U.S. Provisional Application No. 60/284,824, filed Apr. 19, 2001, and hereby incorporated by reference.

FIELD OF THE INVENTION

The present invention is drawn to a fold-up table. More particularly, it is drawn to an apparatus and method for providing a wooden table that folds up for compact storage, yet is sturdy and has the appearance of a traditional (non-folding) table when assembled.

BACKGROUND INFORMATION

The most common types of storable tables are card tables and banquet tables. Card tables are normally 30" to 38" square or 40" round. They are soft vinyl covered and lightweight. They are also flimsy and prone to excessive racking and appear cheap and old fashioned. Banquet tables are normally 30" wide and available in lengths ranging from 5' to 8'. Some fold in the center. All are supposed to be storable. However they are heavy and awkward and have an industrial appearance. Card tables range in price from $25 to over $100. Banquet tables can be found in the same price range and more.

Higher-end, traditional wooden tables are more attractive, but typically do not fold. Although drop-leaf tables can be used where space is limited, they do not have the appearance or stability of traditional wooden tables.

Prior to the advent of modem folding tables, folding wooden tables, such as U.S. Pat. Nos. 236,197, 1,504,371, and 1,757,260, were more common, but suffered from the unattractiveness of visible leg supports.

BRIEF SUMMARY OF THE INVENTION

It is an object of the invention to provide an apparatus and method for providing a folding wooden table that retains the attractiveness of traditional wooden tables by having hidden hinges and leg supports.

It is a further object of the invention to provide an apparatus and method for providing a folding wooden table that requires no tools for assembly and disassembly.

It is another object of the invention to provide an apparatus and method for providing a folding wooden table that folds flat for storage.

DETAILED DESCRIPTION OF THE INVENTION

Figure 1:
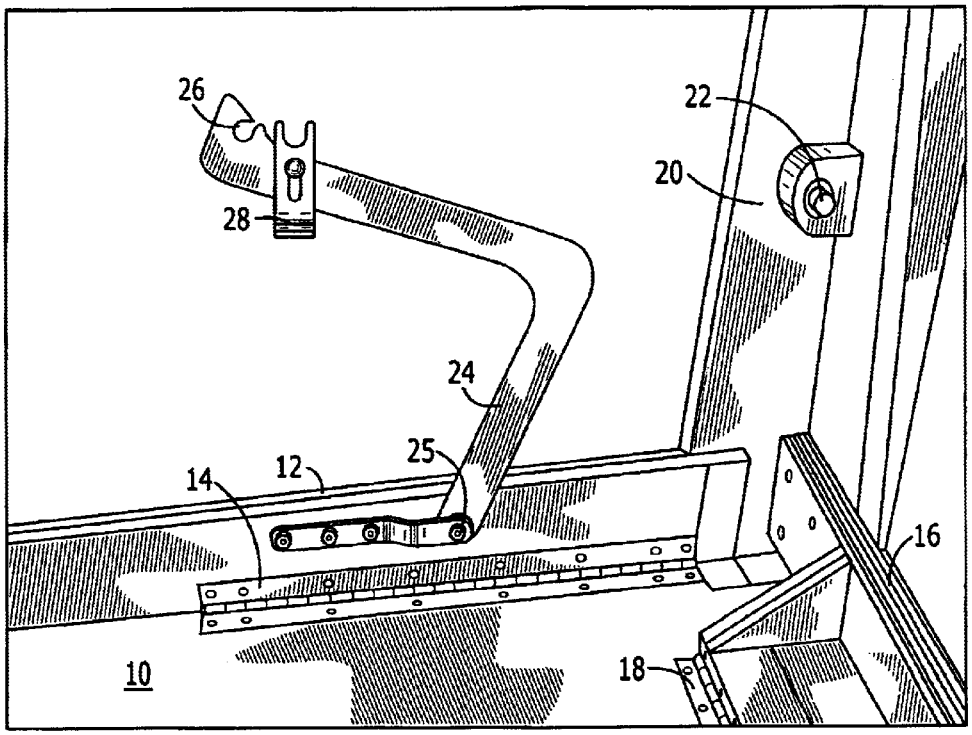
FIG. 1 illustrates the underside of a table of the present invention prior to the support brace being secured.
Figure 2:
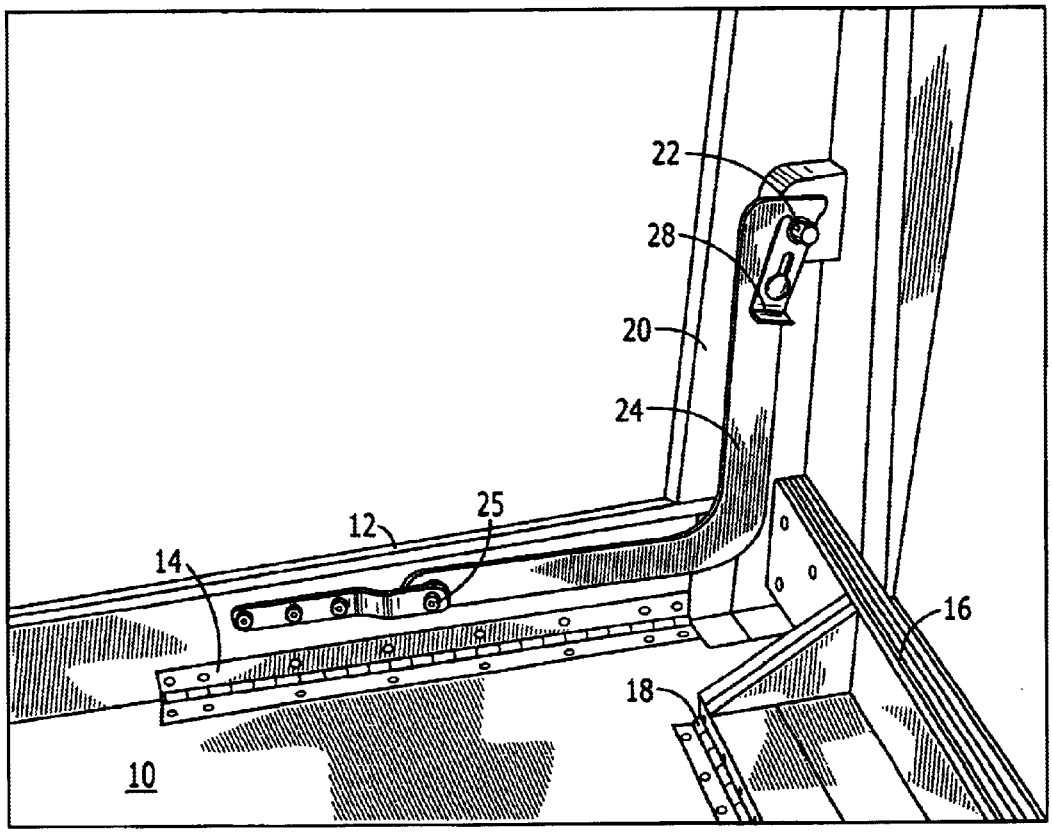
FIG. 2 illustrates the underside of a table of the present invention with the support brace in a secured position.

A preferred embodiment of the present invention is illustrated in FIGS. 1 and 2. The underside of table top 10 has a side skirt 12 pivotally secured adjacent to each side with at least one hinge 14, such as a piano-type hinge, so as to enable them to fold inward. End skirts 16 are pivotally secured to table top 10 at each end with at least one hinge 18. A pair of legs 20 are secured to opposite ends of each end skirt 16 to form a pivoting leg assembly. The legs 20 preferably have an essentially concave cross-section, such the "L"-shaped cross-section illustrated, to hide the support hardware yet provide an attractive exterior. With the configuration illustrated, the hinge 18 is offset sufficiently inward from end skirt 16 to allow legs 20 to fold flat against table top 10. Additionally, the ends of hinge 18 are sufficiently spaced from the sides of the table top 10 to allow the side skirt 12 to fold flat without interfering with the hinge 18.

An "L"-shaped support bracket 24 is secured to each end of side skirt 12 with an appropriately positioned pivot 25. The end of the support bracket 24 opposite pivot 25 includes a retention slot 26 to engage a boss 22 on an inside of leg 20 when rotated into a securing position (i.e., FIG. 2). A sliding and/or pivoting retention member 28 is then used to lock the support bracket 24 into position to complete the erection of the fold-up table.

In a preferred embodiment, as illustrated, the retention member 28 is provided on the support bracket 24 adjacent the retention slot 26. However, it is clear that the retention member 28 could also be provided on the leg 20 adjacent the boss 22. In a preferred embodiment, the boss 22 is a post that has a shoulder and is mounted to the inside of the leg 20.

Although disclosed herein as a wooden table, this is not meant as a limitation since the present invention could be fabricated from other suitable materials, including, but not limited to, metal, plastic, particle board, and combinations thereof.

In use, the table is assembled by pivoting the leg assemblies from a folded position to an erect position. The side skirts 12 are then pivoted from a folded position to an erect position and the support brackets 24 are rotated towards the legs 20 for retention slot 26 to engage boss 22. Retention member 28 is then slid and/or pivoted to secure the support bracket 24.

The table is folded-up by releasing retention member 28, pivoting support bracket 24 away from the legs 20, folding in the side skirts 12, and folding in the leg assemblies.

Although disclosed herein with respect to a particular embodiment, one of ordinary skill in the art will understand that numerous modifications can be made without departing from the scope of the invention, such as by using alternate support bracket and retention means.

What is claimed is:

1. A fold-up table, comprising:

a table top having a pair of opposing sides and a pair of opposing ends;

a pair of side skirts hinged to an underside of said table top adjacent said pair of opposing sides;

a pair of leg assemblies hinged to an underside of said table top adjacent said pair of opposing ends, wherein each leg assembly further comprises:

an end skirt;

a pair of legs secured to opposite ends of said end skirt, each leg having a substantially concave cross-section including a boss on an inner portion; and a second hinge offset sufficiently from said end skirt to allow said legs to fold flat against table top and dimensioned in length to be sufficiently spaced from the sides of the table top to allow the side skirts to fold flat without interfering with the second hinge; and a plurality of "L"-shaped support brackets secured to each end of the side skirts with an appropriately positioned pivot, wherein an end of each support bracket opposite said pivot includes a retention slot to engage said boss on an inner portion of each leg when rotated into a securing position.

2. The fold-up table of claim 1, further comprising a movable retention member positioned to lock the support bracket into position to complete erection of the fold-up table.

3. A method of assembling a collapsed fold-up table of claim 2, comprising:

unfolding the leg assemblies into an erect position;

unfolding the side skirts into an erect position;

rotating the "L"-shaped support brackets to engage the bosses with the retention slots; and moving the retention member into a locking position to complete erection of the fold-up table.

* * * * *